US007280776B2

(12) United States Patent
Cook et al.

(10) Patent No.: US 7,280,776 B2
(45) Date of Patent: Oct. 9, 2007

(54) METHOD AND APPARATUS TO CONTROL WASTE TONER COLLECTION IN AN IMAGE FORMING APPARATUS

(75) Inventors: William Paul Cook, Lexington, KY (US); Derek Masami Inouye, Lexington, KY (US); Tom E. Stickler, Pawleys Island, SC (US)

(73) Assignee: Lexmark International, Inc., Lexington, KY (US)

( * ) Notice: Subject to any disclaimer, the term of this patent is extended or adjusted under 35 U.S.C. 154(b) by 291 days.

(21) Appl. No.: 11/084,980

(22) Filed: Mar. 21, 2005

(65) Prior Publication Data

US 2005/0163545 A1 Jul. 28, 2005

Related U.S. Application Data

(63) Continuation-in-part of application No. 10/647,420, filed on Aug. 25, 2003, now Pat. No. 7,085,507.

(51) Int. Cl.
*G03G 21/10* (2006.01)

(52) U.S. Cl. ..... 399/35; 399/358

(58) Field of Classification Search ..... 399/35, 399/358, 360

See application file for complete search history.

(56) References Cited

U.S. PATENT DOCUMENTS

| | | | | |
|---|---|---|---|---|
| 4,868,599 A | | 9/1989 | Niki | 399/35 |
| 5,198,860 A | | 3/1993 | Yamanaka et al. | 399/27 |
| 5,214,475 A | | 5/1993 | Ishii et al. | 399/27 |
| 5,534,988 A | * | 7/1996 | Gerbasi | 399/358 |
| 6,505,009 B2 | | 1/2003 | Henricus et al. | 399/35 |
| 6,580,881 B2 | | 6/2003 | Coriale et al. | 399/35 |
| 6,640,061 B2 | | 10/2003 | Higgins et al. | 399/35 |
| 6,678,483 B2 | | 1/2004 | Brown et al. | 399/34 |
| 7,107,002 B2 | * | 9/2006 | Saito et al. | 399/360 |

* cited by examiner

*Primary Examiner*—William J. Royer
(74) *Attorney, Agent, or Firm*—Coats & Bennett, PLLC

(57) ABSTRACT

An image forming apparatus includes a waste toner system that collects waste toner in a waste toner container. An amount of waste toner collected in the container is increased by using a driven toner distributing member that distributes accumulated toner within the container. The waste toner system may detect the accumulation of waste toner by monitoring a drive control circuit while the toner distributing member is being driven. For example, the system may detect excess accumulation by comparing the monitored values of a frequency control signal with one or more reference values corresponding to nominal accumulation conditions. An extension may be employed whereby movement of the toner distributing member creates interference between the toner distributing member and the container when the toner distributing member reaches a predetermined position. The interference may be detectable from the drive control circuit as an indication of a full condition.

24 Claims, 10 Drawing Sheets

METHOD AND APPARATUS TO CONTROL WASTE TONER COLLECTION IN AN IMAGE FORMING APPARATUS

CROSS REFERENCE TO RELATED APPLICATIONS

This patent application is a Continuation-In-Part of U.S. patent application Ser. No. 10/647,420, filed Aug. 25, 2003 now U.S. Pat. No. 7,085,507.

BACKGROUND OF THE INVENTION

The present invention generally relates to an image forming apparatus, and particularly relates to waste toner collection in an image forming apparatus.

Image forming apparatus, such as electrophotographic (EP) printers or copiers, typically use a particulate developer material (toner) in their imaging operations. Such machines form output images by depositing toner onto a charged roller or other photosensitive member according to a latent print image and then running that toner to a media sheet.

Some amount of residual toner remains on the photosensitive member after image transfer and requires removal, such as by bringing a cleaning blade or other scraping mechanism into contact with the photosensitive member. The waste toner thus removed oftentimes is collected within a container included in the image forming apparatus. Potentially significant amounts of waste toner may be collected over time, particularly in machines that include multiple process cartridges, each of which acts as a source of waste toner.

SUMMARY OF THE INVENTION

The present invention comprises a method and apparatus to detect accumulation of waste toner in an image forming apparatus. In one or more embodiments, the present invention comprises a waste toner system for use in an image forming apparatus wherein a motor in the image forming apparatus drives a toner distributing member used to distribute accumulated waste toner more evenly within a waste toner container. An exemplary waste toner system comprises a motor control circuit configured to maintain the motor at a desired motor speed over a range of motor loads, and a logic circuit configured to detect accumulation of waste toner within the waste toner container by monitoring the motor control circuit.

For example, the motor control circuit may be configured to vary a speed control signal as needed to maintain a desired motor speed. With that, the logic circuit may be configured to detect accumulation of waste toner by comparing one or more values of the speed control signal generated by the motor control circuit while driving the toner distributing member to one or more stored reference values corresponding to nominal waste toner accumulation conditions.

While not limiting the present invention, the above configuration may offer particular advantages when implemented using a shared motor arrangement. For example, where the image forming apparatus includes a motor to drive one or more image forming process members, that motor also may be used to drive the toner distributing member. Thus, the logic circuit of the waste toner system may be configured to monitor a motor control circuit used in both image forming and toner distributing operations. If the shared motor includes a motor control circuit to regulate its speed, that circuit also may be shared with the waste toner system.

In an exemplary shared motor configuration, the waste toner system may further comprise a drive apparatus including a first drive apparatus to drive the image forming process member in forward and reverse directions of the shared motor, and a second drive apparatus to selectively engage the first drive apparatus to thereby drive the toner distributing member in one motor direction but not in the other motor direction. For example, where a media alignment roller motor is used as the shared motor, the toner distributing member may be disengaged during forward rotation of the roller, e.g., the media feeding direction, to avoid adding additional loading at those times.

Independent of motor sharing and drive details, an exemplary toner distributing member comprises a reciprocating toner rake, such that the logic circuit may detect accumulation of waste toner within the waste toner container by monitoring values of a speed control parameter generated by the motor control circuit over one or more raking cycles of the toner rake. For example, the logic circuit may detect a near full condition of the waste toner container by determining a difference between one or more values of the speed control parameter generated during one or more forward strokes of the toner rake and one or more values of the speed control parameter generated during one or more reverse strokes of the toner rake. Similarly, the logic circuit may detect a near full condition of the waste toner container based on determining a difference between maximum and minimum values of the speed control parameter generated over one or more raking cycles of the toner rake.

Of course, the above information is not comprehensive in terms of describing all of the features and advantages of the present invention in its various exemplary embodiments. Those skilled in the art will recognize additional features, advantages, and opportunities for variation upon reading the following details and examining the associated illustrations.

DETAILED DESCRIPTION

Figure 1:
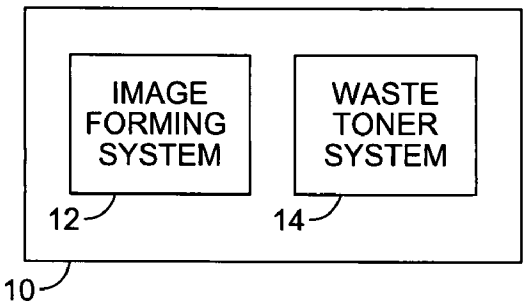
FIG. 1 is a diagram of an exemplary image forming apparatus in which the present invention may be embodied.

FIG. 1 presents a much-simplified illustration of an image forming apparatus 10 as comprising an image forming system 12 and a waste toner system 14. Of course, the two systems as a matter of practical implementation may not actually be implemented in such cleanly separated fashion in an actual image forming apparatus 10. Thus, it should be understood that FIG. 1 provides a basis for beginning a discussion of exemplary details rather than as a literal depiction of any electromechanical and electro-optical systems within image forming apparatus 10. One may refer to the "C750" series electrophotographic (EP) printer manufactured by Lexmark International, Inc., for an example of image forming apparatus details.

Regardless of its specific implementation details, image forming apparatus 10 uses a consumable developer material, such as particulate toner, to form desired images on media sheets processed by it. Thus, image forming apparatus 10 may be a "laser" printer, copier, facsimile, etc. During imaging operations, the image forming apparatus 10 forms desired images, e.g., text, graphics, etc., by transferring developer from one or more image transfer members, such as rotating photoconductive drums, to copy sheets or other media being fed through the image forming apparatus 10. Residual developer material is scoured or otherwise cleaned from the image transfer members between image forming operations to maintain the requisite print quality. This residual developer material, which broadly is referred to as "waste toner" herein, is collected within image forming apparatus 10 in a controlled fashion.

For purposes of this discussion, the image forming details are not important to understanding the present invention. Rather, the focus properly is on the waste toner system 14 in terms of its operations vis-à-vis the waste toner being accumulated in the image forming apparatus 10. In selected embodiments, the discussion further focuses on the cooperative sharing of elements between the image forming system 12 and the waste toner system 14.

Figure 2:
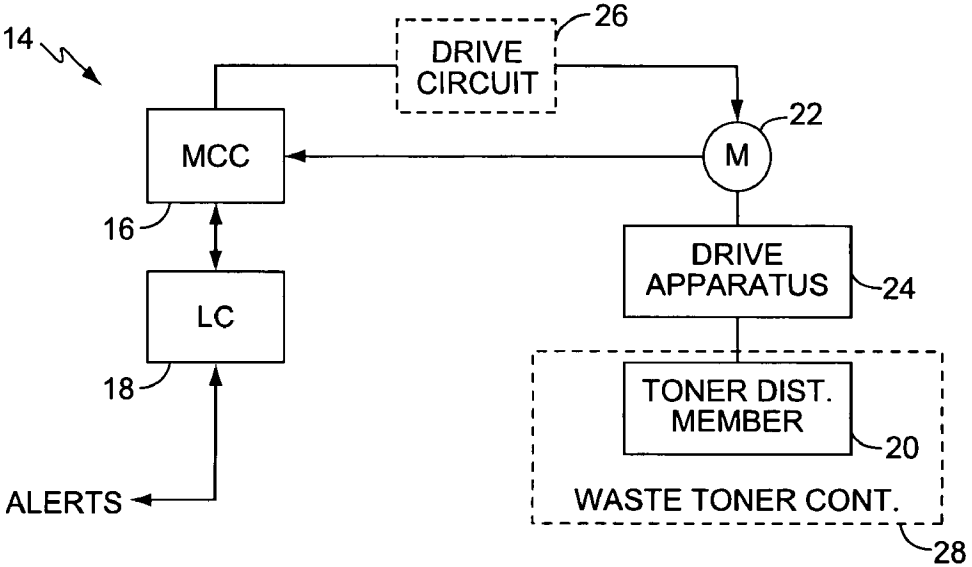
FIG. 2 is a diagram of an exemplary waste toner system.

FIG. 2 illustrates an exemplary waste toner system 14 comprising a motor control circuit (MCC) 16 and a logic circuit (LC) 18, and that further includes, or at least is associated with, a toner distributing member (TDM) 20, a motor (M) 22, a drive apparatus 24, and a motor drive circuit 26. As illustrated, the TDM 20 is movably positioned within a waste toner container 28 although other arrangements are contemplated.

In operation, waste toner produced from ongoing imaging operations of the image forming apparatus 10 is conveyed to and collected in waste toner container 28. Thus, waste toner accumulates in container 28 and at some point container 28 must be removed and emptied or replaced. As this represents an ongoing point of service, it is desirable to accumulate as much waste toner as possible in container 28 before requiring its removal. In other words, it is desirable to fully use the volumetric capacity of container 28 for the collection of waste toner.

Although it may be difficult to achieve a 100% packing efficiency, TDM 20 greatly aids in the efficient use of the interior volume of container 28 by "spreading" or otherwise distributing accumulated toner within the interior of container 28. Motor 22 drives TDM 20 via drive apparatus 24 such that the TDM 20 oscillates, vibrates, rotates, reciprocates, or otherwise moves within container 28 to accomplish the desired spreading of accumulated waste toner therein.

Even aided by the spreading operations of TDM 20, container 28 eventually reaches a "full" condition after which no additional waste toner should be collected in it. Indeed, one or more exemplary embodiments of the present invention prohibit additional image forming operations until the full condition, once detected, is relieved. Such prohibition avoids overfilling the waste container 28 and reduces the possibility of contaminating the interior of the image forming apparatus 10 with waste toner overflow.

An exemplary embodiment of the waste toner system 14 detects the full condition of container 28 based on monitoring MCC 16 while motor 22 is driving the TDM 20. Waste toner system 14 also may detect a "near full" condition of container 28 to gain the valuable benefit of alerting users of the image forming apparatus 10 that container 28 is nearing its capacity limit. Both conditions may be detected, for example, by monitoring one or more control signals of MCC 16 while it is controlling motor 22 during toner distributing operations. It should be noted that such monitoring may be based on analog or digital signals and that the present invention contemplates a variety of monitoring schemes.

Figure 3:
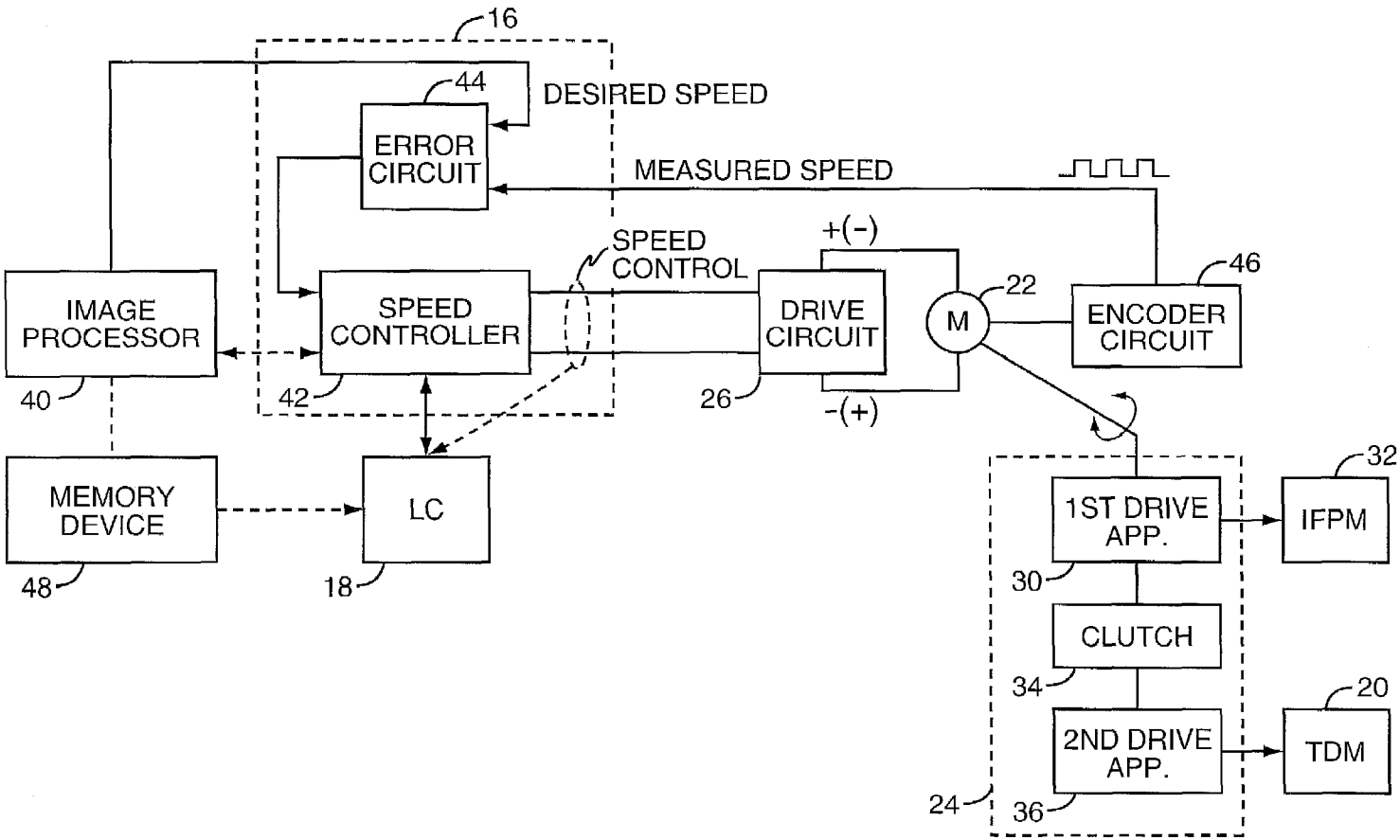
FIG. 3 is a diagram of another exemplary waste toner system.

FIG. 3 illustrates another exemplary waste toner system 14, wherein motor 22 comprises a shared motor used in image forming operations as well as in toner spreading operations. An exemplary drive apparatus 24 thus drives an image forming process member (IFPM) 32 and TDM 20, and includes a first drive apparatus 30 to drive IFPM 32, and further includes a selective engagement device (e.g., one-way clutch) 34 to selectively drive a second drive apparatus 36 that is coupled to TDM 20. Note that in some embodiments, IFPM 32 may function as an element of drive apparatus 30 such that clutch 34 is driven by the rotation of IFPM 32, for example. FIG. 3 further illustrates an image processor 40, a speed controller 42 and error circuit 44 within MCC 16, an encoder circuit 46, and one or more storage elements (e.g., memory device(s)) 48.

In exemplary operation, MCC 16 controls the direction and speed of motor 22 based on an output speed control signal generated by the MCC 16. In an exemplary embodiment, speed controller 42 comprises a Pulse Width Modulation (PWM) controller that generates an output pair of PWM signals wherein, as is well understood in the art, the relative pulse polarities control the direction of motor 22 and the pulse widths control the speed of motor 22.

As motor 22 turns, encoder circuit 46 generates a feedback signal that indicates motor speed. The signal may be a proportional analog signal or may be a digital signal. For example, encoder circuit 46 may comprise a photo-interrupter based encoder circuit that generates output pulses at a frequency related to the motor's rotational speed. Error circuit 44 of MCC 16 receives the speed feedback signal as one input and receives a reference (desired speed) signal as a second input. The error signal output by error circuit 44 indicates error between actual and desired motor speed, and thus serves as a control input to speed controller 42. MCC 16 thus functions as a feedback control circuit configured to vary its output speed control signal as needed to maintain a desired motor speed over a range of motor loads.

In a PWM-based embodiment, speed controller 42 may comprise an n-bit PWM generator that controls motor speed by varying the duty cycle of its output PWM from about 0% to about 100% as needed to maintain the desired motor speed. N-bit PWM control provides $2^n-1$ pulse width adjustment resolution, so an exemplary 16-bit PWM controller offers a numerical control range from 0 to 65,535. With this approach, speed controller 42 may be loaded with a PWM value corresponding to a desired motor speed and, in operation, adjust that value up or down as needed based on the error signal from error circuit 44. Thus, the speed control signal monitored by logic circuit 18 may be the "live" PWM value of speed controller 42, which may be provided to logic circuit 18 as a digital value, or logic circuit 18 may monitor the output PWM signals.

An exemplary drive circuit 26 may be implemented as an H-bridge motor drive circuit comprising a transistor-based push-pull arrangement that allows polarity reversal across motor 22 to enable operation in forward or reverse motor directions as desired. Those skilled in the art will appreciate that speed controller 42 may generate a speed control signal as a complementary pair of PWM waveforms to drive the H-bridge transistors. The natural impedance of motor 22, which may be a dc motor, acts as a low-pass filter to average the PWM pulses applied to drive circuit 26 such that the average drive voltage across the motor is a function of the modulated pulse width and frequency. The RS385-15155 dc motor manufactured by MABUCHI MOTOR AMERICA CORP., which maintains a business address of 3001 West Big Beaver Road, Suite 520, Troy, Mi. 48084 U.S.A., represents an exemplary dc motor.

Such speed control complements the shared-motor drive arrangement. In the illustrated shared-motor embodiment, drive apparatus 24 drives both IFPM 32 and TDM 20 when motor 22 rotates in one direction, and drives only IFPM 32 when the motor 22 rotates in the other direction. To accomplish this, clutch 34 is configured to engage second drive apparatus 36 when the motor 22 drives the first drive apparatus 30 in one direction of rotation, and disengage second drive apparatus 36 when motor 22 drives it in the other direction.

For example, if IFPM 32 comprises a bump/alignment roller used in the image forming process to feed in and align media sheets prior to image formation, one rotational direction of motor 22 corresponds to a forward process direction and the other direction of motor 22 corresponds to a reverse process direction. Thus, clutch 34 of drive apparatus 24 may be configured disengage second drive apparatus 36 in the forward process direction and engage second drive apparatus 36 in the reverse process direction. In that embodiment, motor 22 is not loaded by TDM 20 during potentially sensitive bump/alignment operations associated with driving IFPM 32 in the forward process direction. Rather, TDM 20 is driven whenever motor 22 runs in the less sensitive reverse process direction. Of course, this drive logic may change depending on how motor 22 is shared with the image forming system 10.

Regardless, logic circuit 18 may detect the accumulation of waste toner within container 28 by monitoring MCC 16 while the motor 22 is driving TDM 20. For example, until enough waste toner accumulates to begin interfering with movement of TDM 20, the MCC 16 should not have to substantially vary its speed control signal away from a nominal value to maintain the desired motor speed while driving TDM 20. Once waste toner accumulates in container 28 to the point where it begins interfering with the free movement of TDM 20, however, MCC 16 may have to adjust its speed control signal more substantially to maintain the desired motor speed.

Thus, in an exemplary embodiment, logic circuit 18 is programmed with, or has access to, one or more reference values, e.g., PWM value(s), corresponding to nominal waste toner accumulation conditions. In one embodiment, memory device 48 stores PWM reference values and may store other information, such as detection thresholds, etc. Reference values may be obtained, for example, by observing the speed control signal value needed to maintain a desired motor speed while driving TDM 20 with an empty container 28. By monitoring the PWM value(s) actually generated by MCC 16 while driving TDM 20, and comparing those monitored values to one or more reference values, logic circuit 18 may detect when (and to what extent) excess accumulated waste toner has begun interfering with the movement of TDM 20.

Logic circuit 18 may provide the desired speed information to MCC 16, or it may be provided by the image processor 40. Indeed, because logic circuit 18 may be implemented using a microprocessor configured to execute coded program instructions, logic circuit 18 may be incorporated into image processor 40. Of course, it should be understood that logic circuit 18 may be implemented as discrete logic, or as a stand-alone microprocessor or other programmable device, etc., and that, in general, it may be implemented in hardware, software, or some combination thereof. Similarly, MCC 16 may be implemented in hardware, software, or some combination thereof, and may be integrated with other function elements or implemented as a stand alone circuit, as needed or desired.

The inclusion of logic circuit 18 within image processor 40, which may be referred to as a "Raster Imaging Processor" or RIP, is beneficial in that image processor 40 already includes the necessary logic to interact with and monitor MCC 16 because of its need to control motor 22 during imaging operations involving the IFPM 32. For example, image processor 40 may require that IFPM 32 be moved or rotated according to precise velocity profiles that ensure synchronization of IFPM 32 within the overall image forming process.

Figure 4:
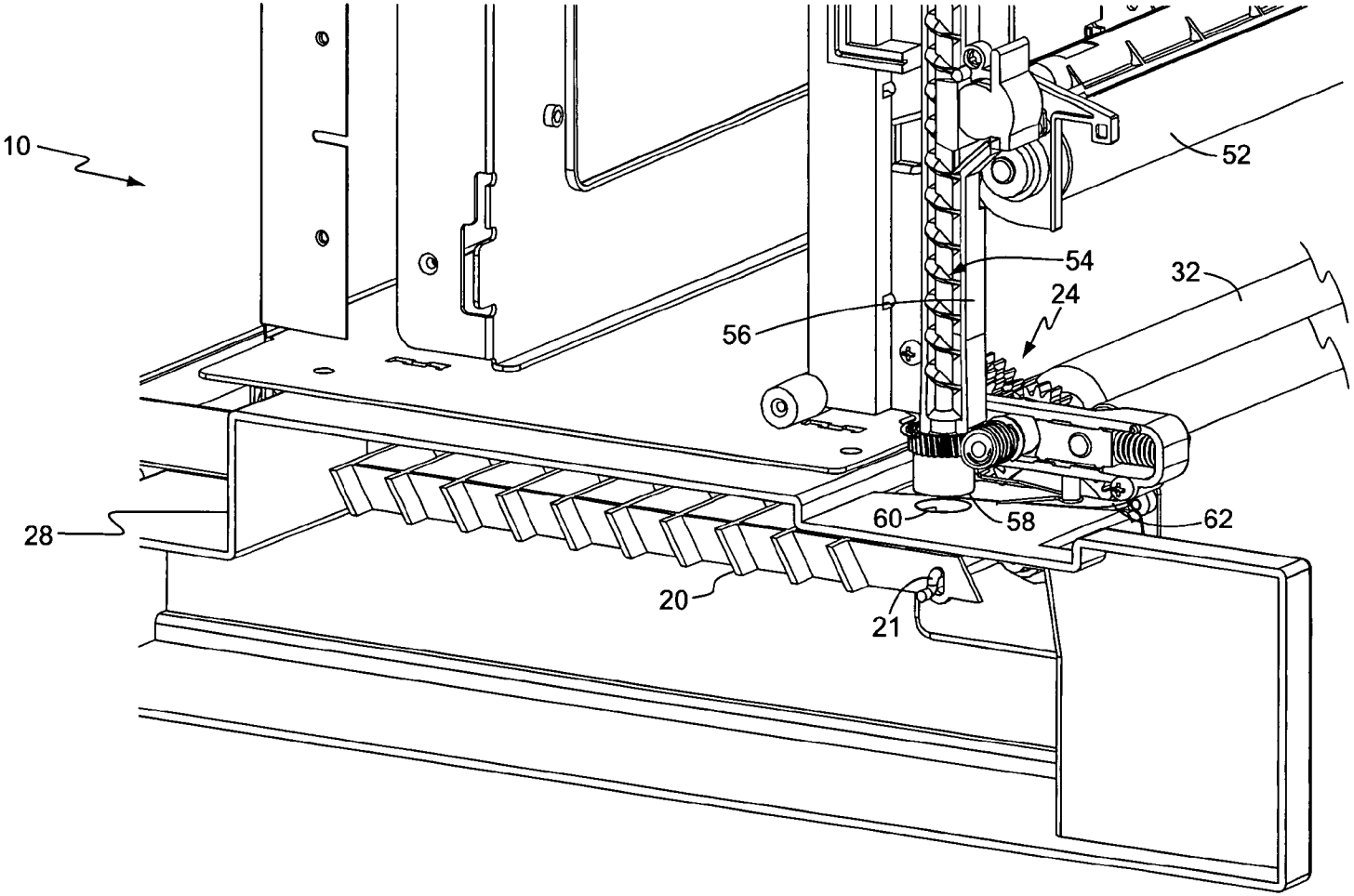
FIG. 4 is a diagram of selected elements of an exemplary waste toner system shown in perspective view within an exemplary image forming apparatus.

To better understand an exemplary embodiment of these detection operations, FIG. 4 provides a perspective view of selected details for image forming apparatus 10. An exemplary waste toner system 14 is configured to accumulate waste toner resulting from the imaging operations and includes motor 22 shared by the image forming and waste toner systems 12 and 14, respectively, waste toner container 28, toner distributing member 20, MCC 16, logic circuit 18, drive apparatus 24, and one or more waste toner transport members configured to receive waste toner from the image forming system 12 and transport the received waste toner to the waste toner container 28.

In the illustrated embodiment, the TDM 20 comprises a horizontally reciprocating toner rake 20 that is movably positioned at an upper elevation within container 28. A reciprocating arm 21 couples rake 20 to a drive gear (not shown here), which forms a part of drive apparatus 24.

The waste toner transport members include a vertical screw auger 54 enclosed within a vertical shaft (tube) 56. During imaging operations, residual toner is removed from one or more image transfer members 52. The waste toner is conveyed downward by screw auger 54. The terminal end 58 of shaft 56 is aligned with an inlet 60 formed as a topside opening into container 28 (note that a seal, e.g., item 84, FIG. 7, would typically be used to close any gap between shaft 56 and inlet 60). Thus, collected waste toner flows downward through shaft 56, through inlet 60 and falls into container 28. Absent operation of the toner rake 20, the accumulated waste toner would tend to pile up in container 28 in the area below inlet 60.

In an exemplary embodiment of the present invention, motor 22 is used to drive rake 20 at a desired motor speed. Within its control range, MCC 16 varies a speed control signal as needed to maintain motor 22 at the desired speed while driving rake 20. Therefore, logic circuit 18 may be configured to detect accumulation of waste toner by monitoring the speed control signal, which changes in a characteristic fashion as excess accumulated waste toner begins interfering with movement of toner rake 20.

In one embodiment, memory device 48 holds a characteristic value (or values) for the speed control signal that correspond to nominal accumulation conditions. In this context, nominal accumulation conditions denote accumulation levels below the point at which accumulated toner begin to impede movement of rake 20 in any substantial sense. Thus, logic circuit 18 may record the value or values observed for the speed control signal generated by the MCC 16 while driving toner rake 20 with an empty container 28. Logic circuit 18 could update those reference values over time to account for changing characteristics, such as increased wear on drive apparatus 24, although the reference range should not change that much with normal wear. Therefore, image forming apparatus 10 could be pre-programmed with the proper reference value(s), which could involve loading them into configurable memory or hard-coding them into a computer program that implements the detection logic of the present invention.

In any case, an exemplary speed-control based detection method is implemented as follows. During the times when motor 22 is driving rake 20, the logic circuit 18 monitors a speed control signal generated by MCC 16 to detect accumulation. Such monitoring may be based on logic circuit 18 monitoring analog or digital control values, output values, etc. In an exemplary embodiment, logic circuit 18 monitors PWM control values generated by MCC 16 to vary the drive voltage of motor 22 as needed to maintain the desired motor speed.

With 16-bit PWM control, for example, a digital control word may be varied from 0 (0% duty cycle) to 65,535 (100% duty cycle). A nominal driving value may be, for example, a midpoint value of 32,767. Therefore, by monitoring the differences between nominal and actual values and/or by monitoring changes in the actual values during toner spreading operations, the logic circuit 18 can determine whether excess toner has accumulated within waste toner container 28. In other embodiments, logic circuit 18 may monitor some other speed control parameter used in the feedback control loop of MCC 16, and thus may simply receive one or more digital values generated by MCC 16 as part of its speed control operation. Regardless, logic circuit 18 can detect whether accumulated waste toner is interfering with rake movement by comparing the monitored values to the appropriate stored reference values.

If the difference between the monitored and reference values is large, indicating that MCC 16 is applying an increased drive voltage to motor 22 to maintain the desired speed, logic circuit 18 may infer that accumulated waste toner has begun impeding rake movement. In particular, in an exemplary embodiment, logic circuit 18 monitors the MCC 16 over one or more raking cycles, wherein a raking cycle comprises the forward and corresponding reverse reciprocating movement of the rake 20.

As excess waste toner accumulates to the level of rake 20, its forward movement tends to push the top of the toner pile away from the outlet, which thereby causes it to fall away from the peak of the pile and thereby spread out. As long as open space remains below the rake 20, then, the return stroke of the rake 20 will be relatively unimpeded. Note that an exemplary rake design may include angled raking elements to enhance raking in the direction away from the toner inlet area of container 28.

Logic circuit 18 may detect a near full condition by comparing one or more speed control values generated during the forward stroke of rake 20 with one or more values generated during the return (reverse) stroke. (Note that logic circuit 18 may average forward and reverse values over several raking cycles and compare averaged forward and reverse values.) If the speed control values corresponding to forward and reverse rake movements exhibit a characteristic difference, logic circuit 18 may infer that the waste toner container 28 is in a near full condition. The logic circuit 18 may generate a near full signal and communicate that signal to image processor 40 (or to another processing system in image forming apparatus 10). In an exemplary embodiment, image forming apparatus 10 alerts users to the near full condition by displaying a message, light, emitting an audio alert, etc., which gives users a chance to empty the container 28 before it fills completely.

Similarly, logic circuit 18 may detect a full condition of container 28 by detecting that the speed control values generated for forward and reverse rake strokes exceed a threshold corresponding to nominal accumulation conditions. If rake 20 encounters resistance on both forward and reverse rake strokes, logic circuit 18 may infer that excess waste toner has accumulated to the point where there is little free space remaining within container 28. Logic circuit 18 may generate a full condition signal that may be used to cause image forming apparatus 10 to prohibit image forming operations until container 28 is removed and emptied or replaced.

Those skilled in the art will appreciate that the present invention contemplates various refinements of the above monitored-to-reference value comparisons. For example, the maximum and minimum values of one rake cycle, or the averaged maximum and minimum values developed over two or more raking cycles, may be compared to a reference value indicative of nominal accumulation conditions. If both the maximum and minimum monitored values exceed the nominal value by a defined threshold (or thresholds), then the logic circuit 18 may deem the container 28 full.

One or more hysteresis bands could be used to prevent false full or near-full detections, or to otherwise smooth out the detection response. Alternatively, or additionally, a tolerance could be built into the nominal value, such as by storing a range of values, or a tolerance could be applied on the fly by scaling the nominal value by +5% for example to arrive at a threshold value for comparison to monitored values.

In any case, in addition to illustrating rake 20, FIG. 4 also illustrates at least a portion of its associated drive apparatus 24 and thus provides a basis for discussing exemplary drive apparatus details. More particularly, FIG. 3 illustrated the use of motor 22 as a shared motor for the dual benefit of speed-controlled motor operation during both image forming and toner spreading operations. The diagram also introduced additional drive apparatus details indicating that a first drive apparatus 30 may be used to drive IFPM 32 and that a second drive apparatus 36 may be used to drive the TDM 20.

In fact, whether or not motor 22 is speed-controlled, the schematic and diagrammatic representations of FIGS. 3 and 4 illustrate an exemplary drive apparatus 24 that allows essentially any type of motor to be shared by the image forming system 12 and the waste toner system 14 in a manner that avoids potential interference with precision motor operation during imaging operations. Specifically, clutch 34 may be used to engage the second drive apparatus 36 on a selective basis as a function of the motor's direction of rotation.

Figure 5:
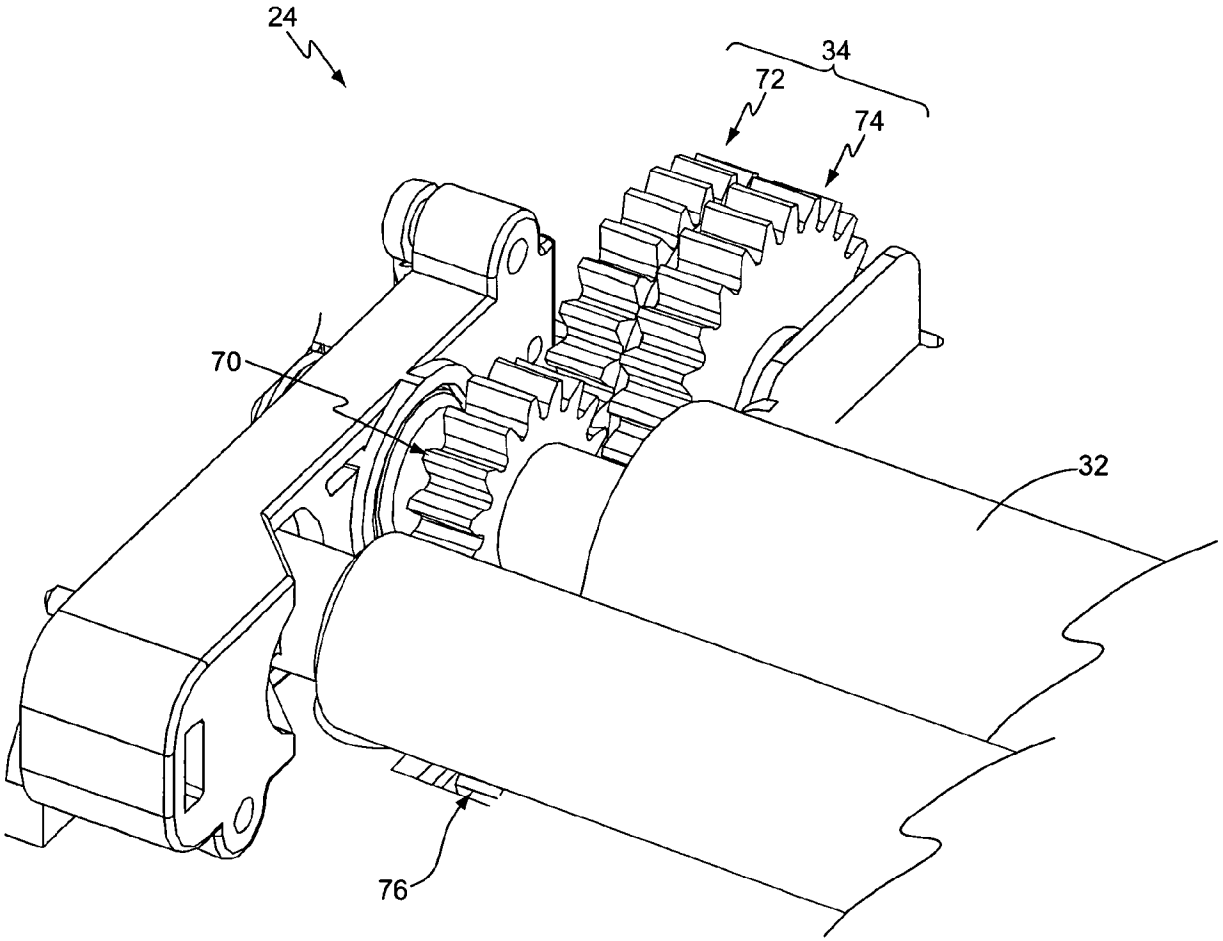
FIG. 5 is a diagram of selected elements of an exemplary drive apparatus shown in perspective view.

FIG. 5 illustrates the same end of IFPM 32 as shown in FIG. 4 but provides more details regarding an exemplary gear arrangement. IFPM 32 may be a media alignment roller, for example, that is used to feed media sheets into an image forming path (not shown) of the image forming system 12. As such, the roller is operated in a forward direction (relative to the feed direction of the media) to feed media sheets into the image forming system 12. When operating in the forward direction, it may be undesirable from a motor control perspective, to subject shared motor 22 to the additional (and potentially variable) load associated with driving the TDM 20.

Thus, one-way clutch 34 is configured to engage the first drive apparatus 30 with the second drive apparatus 36 when the motor 22 rotates in the reverse process direction, where control of IFPM 32 is not critical to image formation timing, but not in the forward process direction. The forward and reverse directions of motor 22 thus should be understood as referring to the process-related operation of IFPM 32. FIG. 5 provides more detail.

In FIG. 5, one sees a drive pinion 70 attached at one end of IFPM 32—the motor 22 is coupled to the other end—and that pinion 70 engages a first gear 72 of clutch 34. Thus, rotation of IFPM 32 by motor 22 in either direction causes a counter rotation of gear 72. A second gear 74 is positioned adjacent to and on the same rotational axis of gear 72. The interior faces of adjacent gears 72 and 74 are configured such that gear 72 engages gear 74 in one direction of rotation but not in the other. With this configuration, then, gear 74 drives gear 76 if the motor 22 rotates in one direction, but not when it rotates in the other direction. Gear 76 is coupled to rake drive arm 21 shown in FIG. 4 and, thus, the TDM 20 is driven in one motor direction but not the other. Of course, those skilled in the art immediately will appreciate that other selective engagement drive arrangements may be used as needed or desired.

Figure 6:
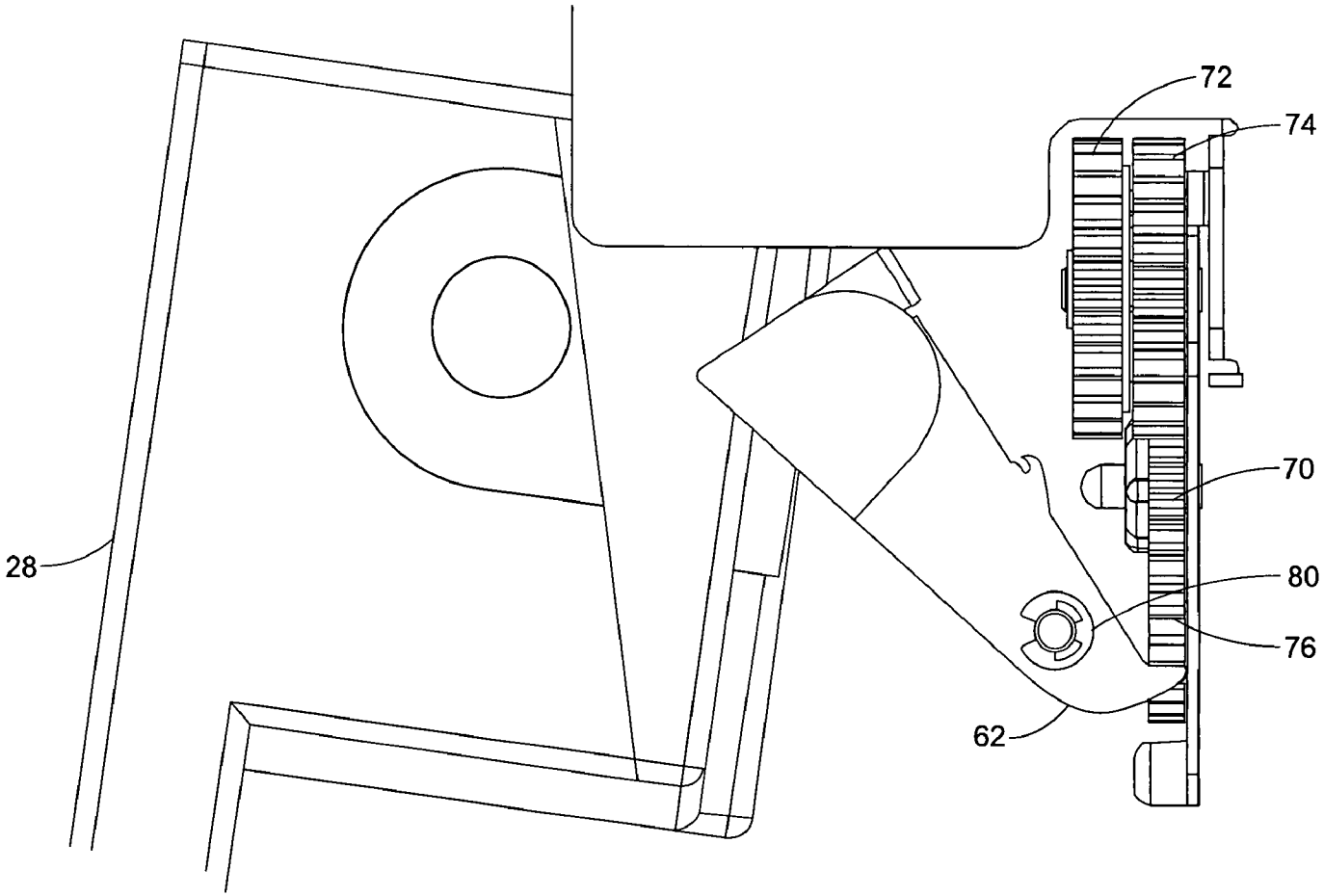
FIG. 6 is a diagram of selected elements of an exemplary drive apparatus, including an exemplary drive locking system, shown in plan view.
Figure 7:
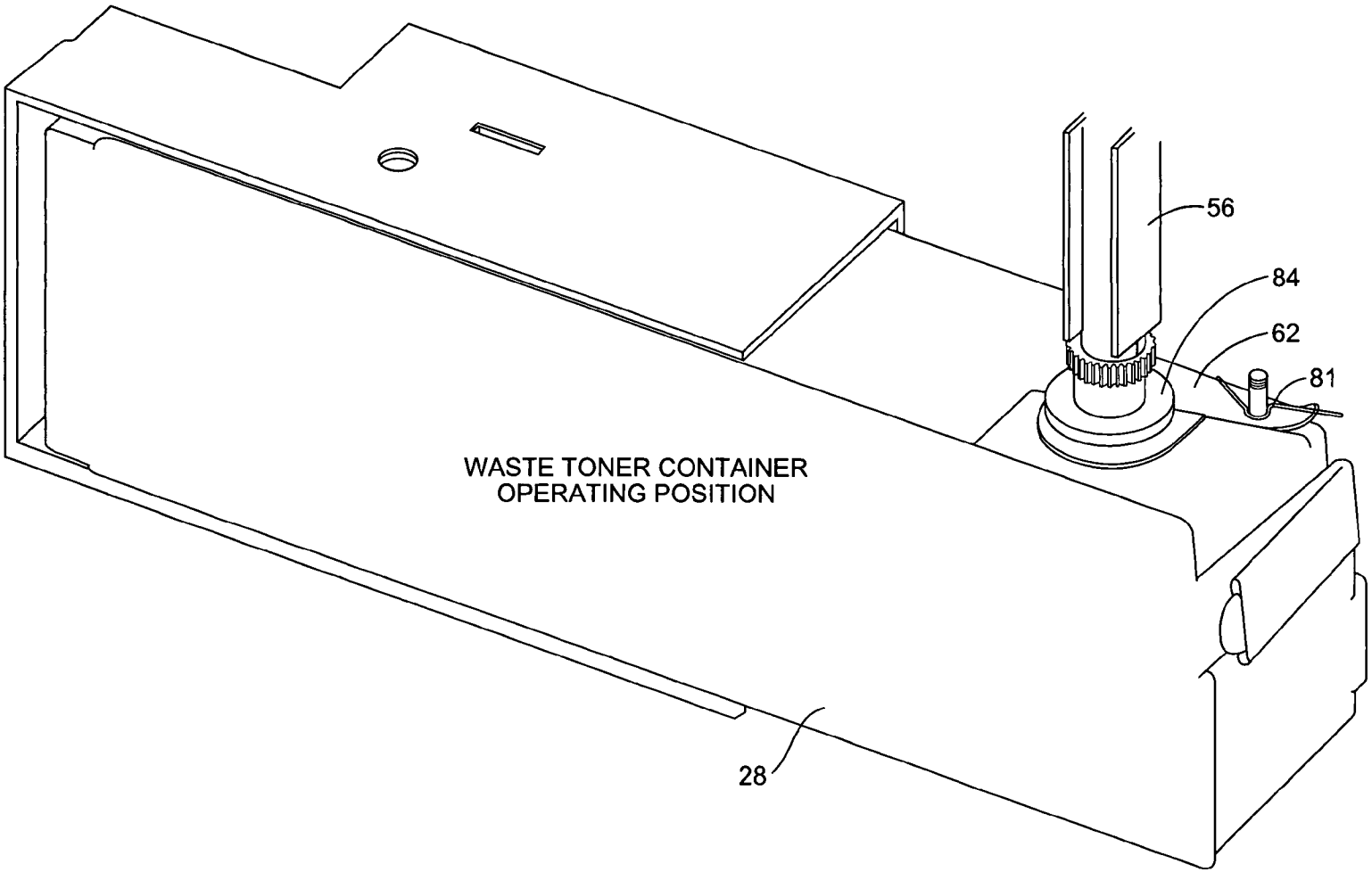
FIG. 7 is a diagram of an exemplary waste toner container shown in perspective view.

In an exemplary addition to drive apparatus 24, FIG. 6 illustrates the inclusion of a locking system 62 first illustrated in FIG. 4. FIG. 7 illustrates substantially the same details with the container 28 installed. The locking system 62 is depicted as a pivoting arm that is moved into a disengaged (unlocked) position if container 28 is present and is moved into an engaged (locked) position if container 28 is absent. Specifically, a retaining ring 80 pivotally retains an arm comprising locking system 62 such that it swings into and out of engagement with drive gear 76 (discussed in the context of FIGS. 4 and 5). Note that a spring 81 or other biasing member may be used to urge the arm of locking system 62 into engagement responsive to removal of container 28. Note, too, that a seal 84 may be used to seal any gap between the terminal end 58 of shaft 56 and the inlet 60 opening into container 28.

In operation, drive gear 76, which couples to TDM 20 via drive arm 21, becomes locked by locking system 62 when container 28 is removed from the image forming apparatus 10. Logic circuit 18 and/or MCC 16 may be configured to include stall detection logic, wherein MCC 16 de-energizes motor 22 responsive to its detection of the locked drive condition. The locked drive condition may be detected by, for example, observing a zero measured motor speed irrespective of the speed control signal output by MCC 16.

The locking arrangement illustrated is advantageous in that it also locks the machine elements involved in conveying waste toner downward from the image forming member(s) and prevents dumping waste toner into the open area normally occupied by container 28. Note that imaging may be prohibited responsive to detecting the locked condition.

Figure 8:
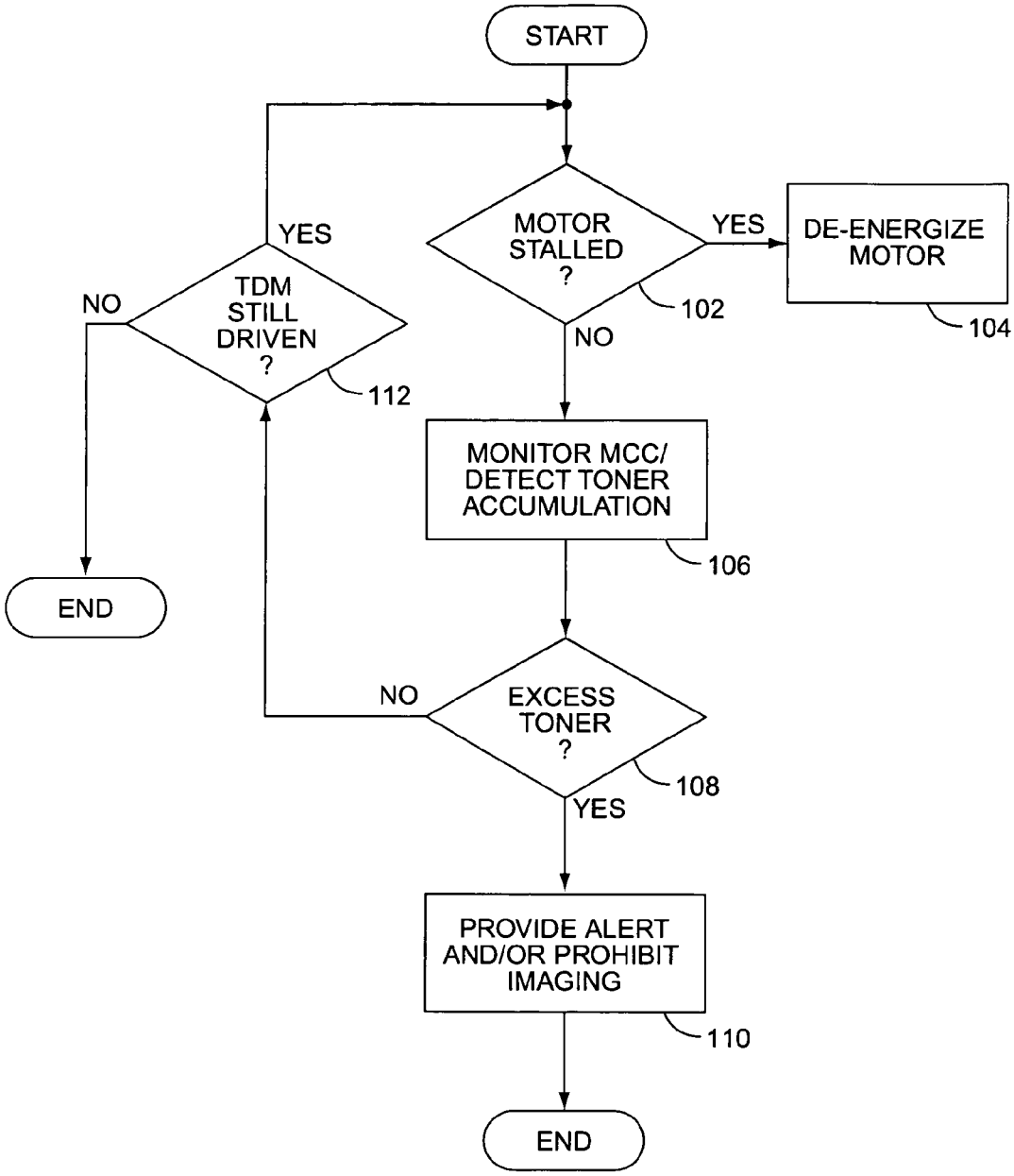
FIG. 8 is a diagram of exemplary processing logic for one or more embodiments of the present invention.

FIG. 8 illustrates exemplary processing logic that may be implemented by waste toner system 14. Assuming that a command has issued to begin running motor 22 at a desired speed for purposes of driving TDM 20, processing starts with the detection of a motor stall condition (Step 102). If the motor 22 is stalled, MCC 16 de-energizes motor 22 (Step 104) to avoid stressing it and/or stressing drive apparatus 24. Here, de-energizing motor 22 may be achieved by, for example, outputting zero width PWM pulses or by removing the source voltage (supply voltage) from motor 22.

If motor 22 is not stalled, processing continues with logic circuit 18 monitoring MCC 16 to detect toner accumulation, as explained above (Step 106). If excess toner accumulation is detected (Step 108), waste toner system 14 provides an alert (e.g., full or near-full), which may be used to warn users and/or prohibit printing (Step 110). If excess toner accumulation is not detected, processing continues with determining whether continued toner distributing operations are desired (Step 112). If so, MCC 16 continues running motor 22 at the desired speed and monitoring/detection continues. Note that the detection operations need not run continuously and may be activated on a periodic basis keyed to time of operation and or the amount of printing activity.

Regarding printing activity, waste toner system 14 may be configured to gain additional toner spreading operations by running motor 22 at times selected not to interfere with imaging operations. For example, where motor 22 drives IFPM 32 and TDM 20 in a reverse process direction, and drives only IFPM 32 in a forward process direction, the waste toner system may find times during or between selected image processing operations in which to run the motor 22 in the reverse direction. Thus, even if the image forming operations naturally require selected reversing of motor 22, the total amount of time that motor 22 is run in reverse intentionally may be extended at selected opportunities to enhance the spreading action of TDM 20.

Figure 9:
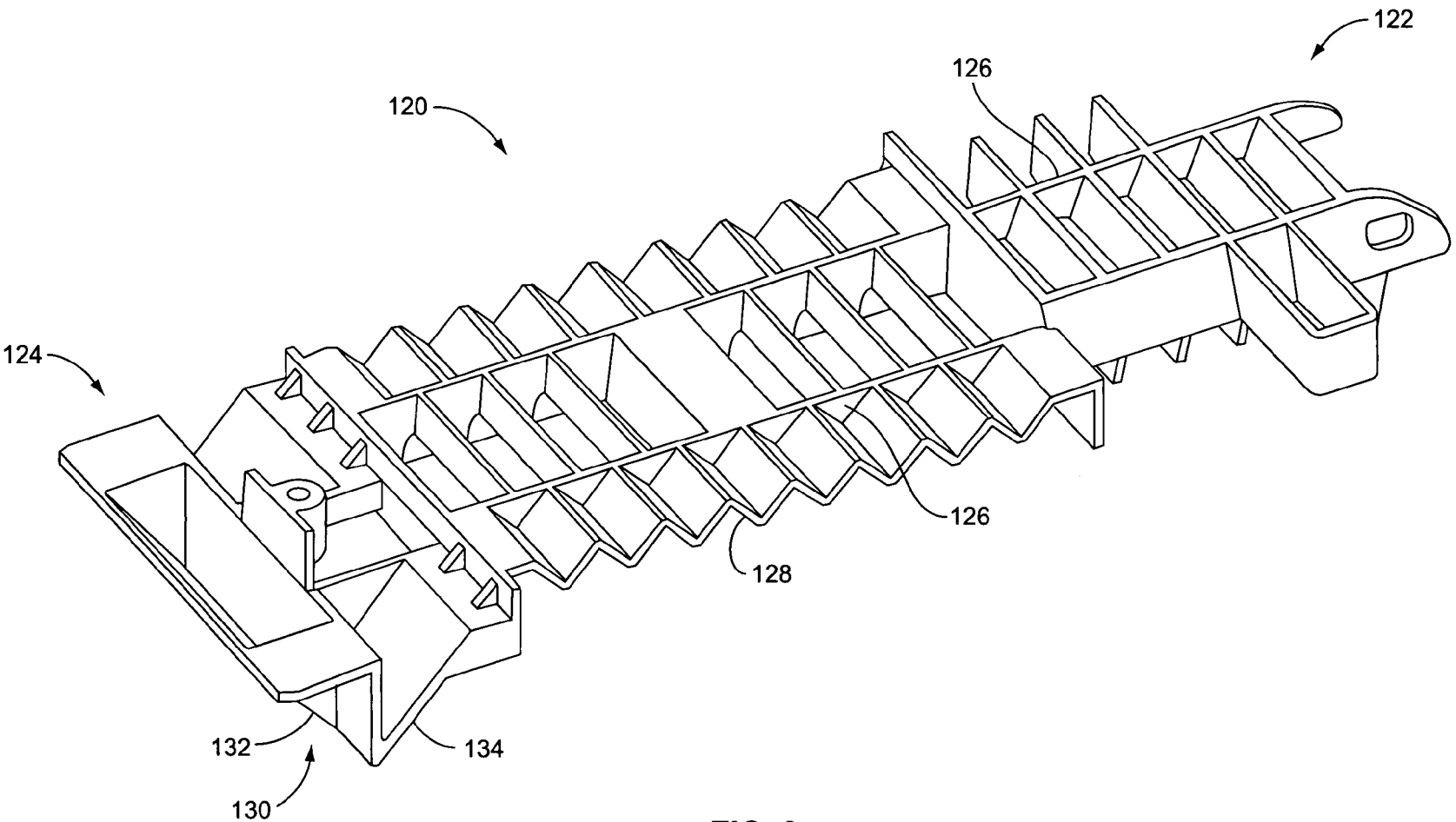
FIG. 9 is a perspective view of one embodiment of a toner distributing member.
Figure 10:
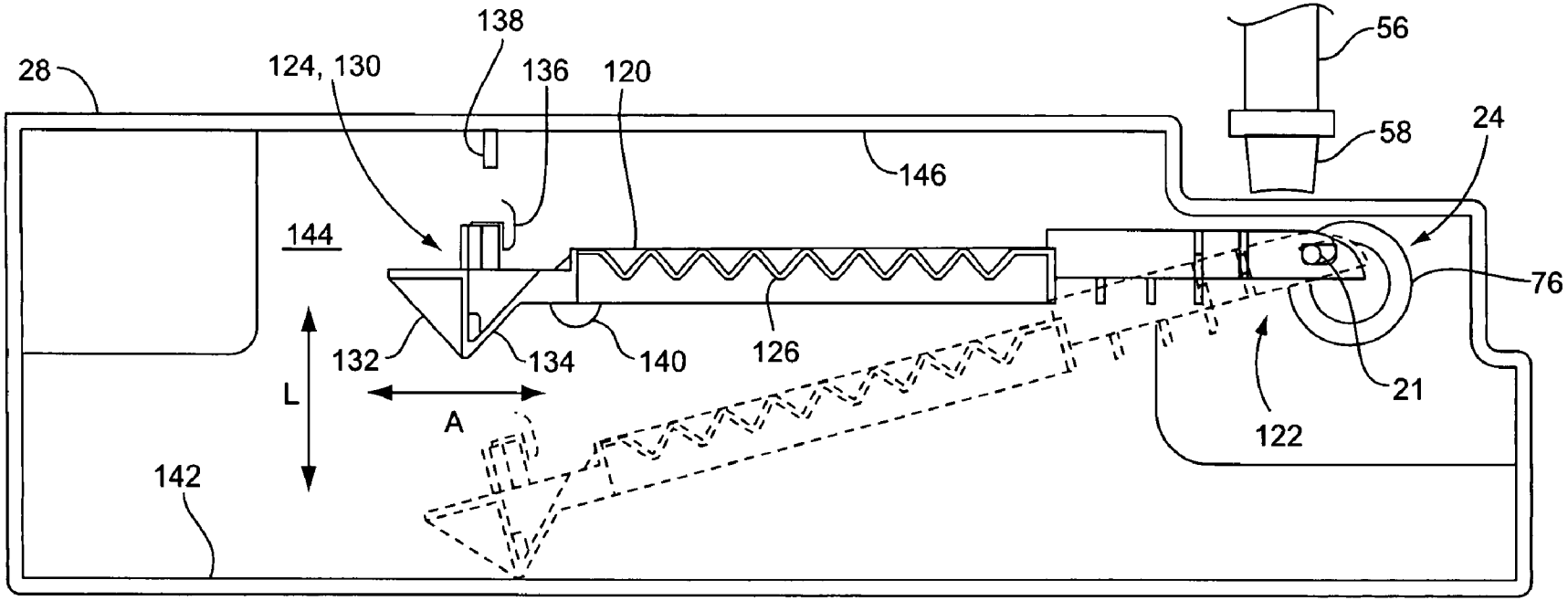
FIG. 10 is a side view of selected elements of an exemplary waste toner system within an exemplary image forming apparatus.

FIG. 9 shows an isolated perspective view of an exemplary toner distributing member (TDM) 120 adapted for use in a waste toner container 28 (not shown in FIG. 9, but see FIGS. 4 and 10). In the present embodiment, the TDM 120 has a generally elongated shape extending between a supported end 122 and a free end 124. The TDM 120 may include one or more longitudinal spines 126 and raking surfaces 128 extending laterally from the spines 126. The spines 126 and raking surfaces 128 are advantageously oriented on the TDM 120 to distribute toner within the container 28. In one embodiment, the raking surfaces 128 function to keep the TDM 120 towards a surface of the toner. The TDM 120 of the present embodiment may also include a floating portion (float feature) 130 having a plurality of floating surfaces 132,134 oriented on the TDM 120 to cause the TDM 120 to remain towards a surface of the toner within the container 28. For instance, floating or leading surface 132 may operate to lift the free end 124 of the TDM 120 during forward movements of the TDM 120. Conversely, floating or trailing surface 134 may operate to lift the free end 124 of the TDM 120 during backward movements of the TDM 120. Various other features may also be incorporated on the TDM 120 to accommodate the shape of the interior of specific waste toner containers 28.

Movement of the exemplary TDM 120 within a waste toner container 28 is shown more clearly in the schematic provided in FIG. 10. Selected components described above are repeated here for consistency. For example, the end 58 of waste toner transport shaft (tube) 56 is included as is the previously described gear 76 that is coupled to drive arm 21 which drives the TDM 120 in a reciprocating manner. The drive arm 21 is simultaneously coupled to the TDM 120 and the rotating gear 76. The drive arm 21 is disposed on the rotating gear 76 in an eccentric manner so that the supported end 122 of the TDM 120 traverses a circular path. This movement about the supported end 122, in turn, imparts a reciprocating, agitating motion at the free end 124 of the TDM 120. The direction of the agitating motion is indicated by the arrows labeled A in FIG. 10. With the TDM 120 moving in this reciprocating manner, the spines 126 and raking surfaces 128 may distribute accumulated toner from areas of heavy accumulation to areas of lighter accumulation within the waste toner container 28.

The supported end 122 of this embodiment of TDM 120 is pivotally coupled to the drive arm 21. This type of coupling permits the free end 124 of the TDM 120 to move not only in the agitating direction A, but also in a lifting direction L to advantageously accommodate an increasing quantity of waste toner within the container 28. In one embodiment (indicated by solid lines in FIG. 10), the free end 124 of TDM 120 is supported by a stop 140 that holds the free end 124 above the bottom surface 142 of the waste toner container 28. With the free end 124 supported in this manner, the TDM 120 may not physically contact waste toner until the toner has accumulated to the height of float feature 130. Leading surface 132 and trailing surface 134 of float feature 130 may advantageously keep the free end 124 towards the surface of the accumulated toner. Raking surfaces 128 may also remain out of contact with accumulating toner until the toner level within the container 28 reaches the height of the supported TDM 120. In this particular embodiment, the TDM 120 will ultimately lift off the stop 140 and the additional drag imparted on the TDM 120 by the toner may be sensed by the motor 22, motor drive circuit 26, motor control circuit 16, and logic circuit 18 shown in FIG. 3.

In another embodiment (indicated by dashed lines in FIG. 10), the free end 124 of TDM 120 may be allowed to fall toward a bottom surface 142 of the waste toner container 28. As previously indicated, the leading surface 132 and trailing surface 134 of float feature 130 operate to keep the free end 124 of TDM 120 towards the surface of the accumulated toner. In this particular embodiment, the raking surfaces 128 may advantageously contact accumulated toner at an earlier time (as compared to the embodiment employing stop feature 140) to distribute the waste toner.

The previously described embodiments may also include an artificial interference mechanism, embodied in FIG. 10 as extension features 136 and/or 138. As previously described, drag imparted on the TDM 20, 120 by interference with accumulating toner in the container 28 may be detectable by the motor 22, motor drive circuit 26, motor control circuit 16, and logic circuit 18 shown in FIG. 3. More specifically, the logic circuit 18 may compare a motor control parameter that varies in relation to the imparted drag in an effort to maintain a constant agitating frequency or speed. Thus, the extension features 136,138 may advantageously impart extra drag on the TDM 20, 120 by creating interference between the moving TDM 20, 120 and the relatively stationary container 28.

In an exemplary embodiment, TDM extension feature 136 coupled at or near the free end 124 of TDM 120 may contact a portion of the container 28 to create the artificial drag. TDM extension feature 136 may advantageously be implemented as a leaf spring or some other resilient device that effectively creates the additional drag without completely impeding the agitating motion of the TDM 120. TDM extension feature 136 is positioned to contact some portion of the container 28 or some extension thereof. For example, container extension feature 138 on the container 28 may represent a rib or other feature integral to the container housing 28. Alternatively, the extension feature 138 on the container 28 may represent a separate member attached to the inside of the container 28. Furthermore, while extension feature 138 is depicted in FIG. 10 as coupled to the roof 146 of the waste toner container 28, the TDM extension feature 136 may also be configured to contact some portion or extension of the side wall 144 or other interior surface of the container 28. It should also be understood that the induced artificial drag may be effectively achieved by adding a resilient extension 136 or 138 to one or both of the TDM 120 and the container 28.

Figure 11:
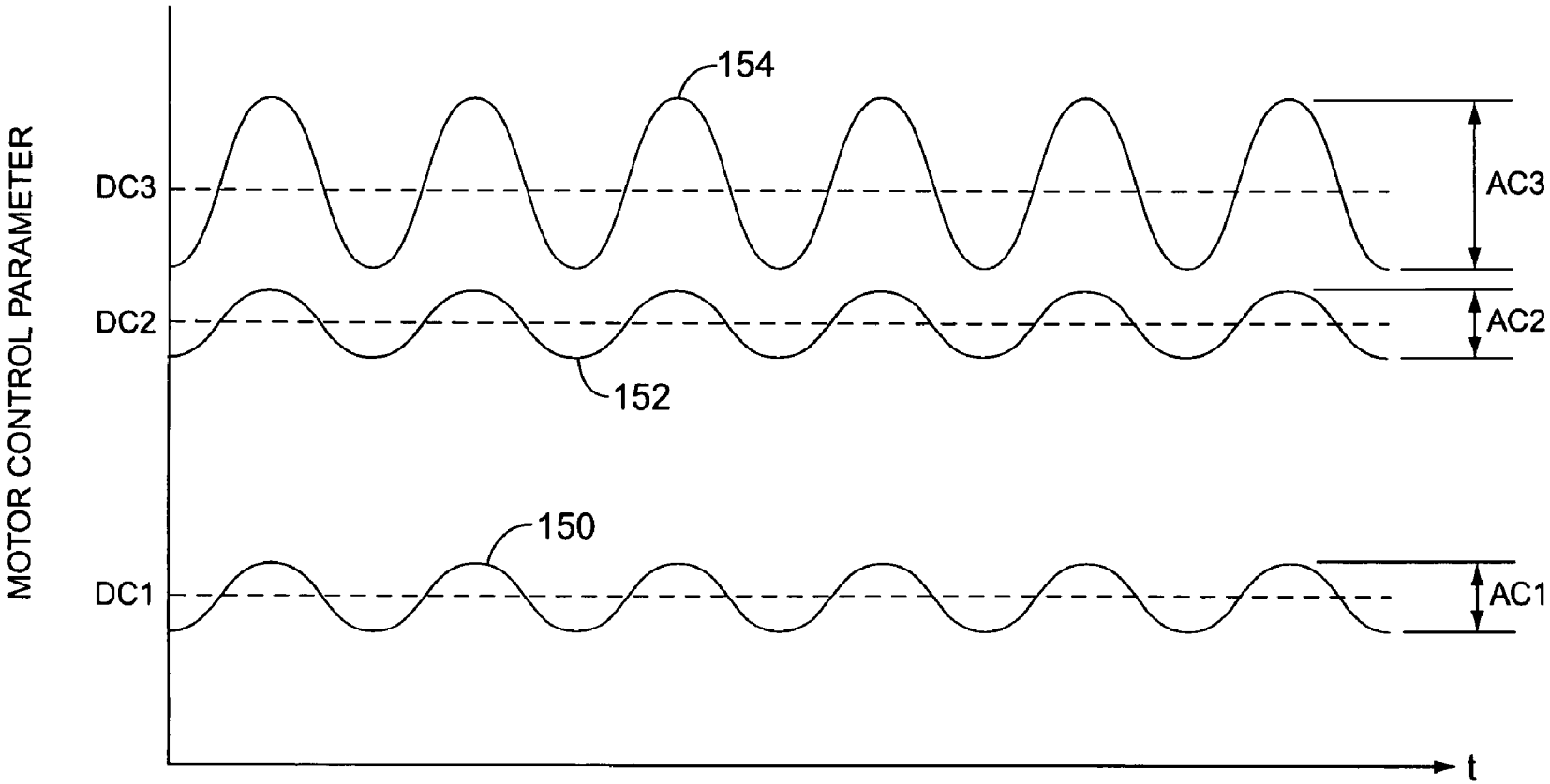
FIG. 11 is a graphical diagram showing exemplary motor control parameter waveforms for one or more embodiments of the present invention.

The graphical waveforms provided in FIG. 11 qualitatively show the effect of drag, imparted on the TDM 20, 120 by toner as well as the extension features 136, 138 on the motor control parameter used to determine toner level. The motor control parameter, as discussed previously, may represent a drive characteristic such as a motor drive voltage or a duty cycle or perhaps a digitized value thereof. In any event, the motor control parameter represents some characteristic signal that varies in relation to the amount of drag imparted on TDM 20, 120. In FIG. 11, three separate waveforms 150, 152, 154 are provided, with the lowermost 150 of the three representing the lightest amount of drag and the uppermost 154 of the three representing the largest amount of drag imparted on the TDM 20, 120. In each of the three instances, the waveform 150, 152, 154 is sinusoidal in nature because of the varying drag imparted on the TDM 20, 120 during each reciprocating (back and forth) cycle. Consistent with other sinusoidal or cyclical signals, each waveform may thus be characterized by a DC component and an AC component. The DC component may be defined as an average value of the motor control parameter over one or more agitation cycles for the TDM 20, 120. The AC component may be defined as the difference between maximum and minimum values of the motor control parameter over one or more agitation cycles for the TDM 20, 120.

Thus, as can be seen in FIG. 11, a light drag condition may be characterized by a relatively small AC and DC value indicated by the DC1 and AC1 labels associated with waveform 150. By way of comparison, the large drag condition represented by the uppermost waveform 154 is characterized by AC and DC values (AC3, DC3) that are larger than the lowermost curve 150. A notable characteristic of the intermediate waveform 152 is that the DC component DC2 is intermediate DC1 and DC3, which is the result of additional toner drag imparted on TDM 20, 120. However, the AC component (AC2) of the intermediate waveform 152 is roughly on the same order of magnitude as the lowermost waveform 150. The AC component of waveform 154 is notably larger than that of waveforms 150 and 152. This discrepancy can be reconciled by noting that the uppermost waveform 154 represents a condition where the TDM 20, 120 is in interference with waste toner container 28 via extension 136, 138. Consequently, and particularly when the interference extension 136, 138 is used, a near full condition may be sensed by detecting the AC component of the motor control parameter waveform 154.

A useful application of these characteristics is that varying levels of a full condition may be monitored, used, and even displayed to the end user. For example, an increase in the DC component of the motor control parameter may represent an increase in toner level that increases drag on the TDM 20, 120, but that does not yet create interference between the TDM 20, 120 and the container 28. However, once the TDM 20, 120 makes initial contact with the container 28 via extension 136, 138, the AC component jumps significantly, providing an indication that the container 28 is near full. At that point, the user may be given a warning that the container 28 is nearly full. Continued printing or copying with the image forming apparatus 10 beyond this point may be limited to a predetermined page count, thus limiting the number of output sheets that may be printed or copied before the container 28 should be replaced. The DC component may be monitored to determine whether the container 28 was replaced or simply pulled out and shaken, thereby causing the TDM 20, 120 to settle and fall out of interference with the container 28. If the DC component remains high after the container 28 is removed and replaced, this may advantageously provide some indication that the full container 28 was not replaced with an empty container 28. Furthermore, the previously mentioned page count may be maintained and not reset. However, if a new, empty container 28 is sensed from a lower DC component of the motor control parameter, the page count may be reset.

The present invention may be carried out in other specific ways than those herein set forth without departing from the scope and essential characteristics of the invention. For instance, the embodiments described have been depicted in use with a TDM 20, 120 that is agitated in a reciprocating manner using an eccentric, rotary gear 76. The TDM 20, 120 may also be reciprocated using a linearly actuated solenoid or other motion translating device. A cam driven rocker actuator may also be used. In another embodiment, the TDM 20, 120 is positioned within an incoming toner container (i.e., unused toner). Of course, those skilled in the art will recognize other potential opportunities to gain additional advantages, and it should be understood that the present invention is not limited by the foregoing discussion, or by the accompanying illustrations, indeed, the present invention is limited only by the following claims and the reasonable equivalents thereof.

What is claimed is:

1. A device to move toner within a waste toner container comprising:

a member movably positioned within the container and having a raking section and a floating section, the member moveable in a reciprocating manner with the raking section oriented to distribute the toner within the container and the floating section oriented to keep the member towards a surface of the toner;

a driving device operatively connected to the member to move the member in the reciprocating manner; and an extension where movement of the member creates interference between the member and the container when the amount of toner in the container reaches a predetermined quantity.

2. The device of claim 1 wherein the member pivots to allow the floating surface to remain towards the surface of the toner.

3. The device of claim 1 wherein the member is adapted to reciprocate in a first direction to distribute the toner within the container, the member further adapted to move in a second direction to accommodate a rising waste toner level and maintain the floating surface towards the surface of the toner.

4. The device of claim 3 wherein the first direction is substantially horizontal.

5. The device of claim 3 wherein the second direction is substantially vertical.

6. The device of claim 1 wherein the interference occurs at least once per reciprocating cycle of the member.

7. A device to move toner within a waste toner container comprising:

a toner distributing member positioned within the container;

a driving device operatively connected to the toner distributing member to move the toner distributing member in a reciprocating motion within the container;

a control circuit configured to move the driving device at a desired operating speed;

a logic circuit configured to detect accumulation of waste toner within the waste toner container by monitoring the control circuit; and an extension where movement of the toner distributing member creates interference between the toner distributing member and the container when the toner distributing member reaches a predetermined position, the interference detectable by the logic circuit.

8. The device of claim 7 wherein the logic circuit generates a full condition signal in response to detecting the interference between the toner distributing member and the container.

9. The device of claim 8 wherein the logic circuit detects the interference between the toner distributing member and the container by sensing that a difference between maximum and minimum values of a motor control parameter generated by the control circuit over one or more reciprocating cycles of the toner distributing member has exceeded a predetermined threshold.

10. The device of claim 7 wherein the extension is coupled to the toner distributing member, the extension configured to contact a portion of the container when the toner distributing member reaches the predetermined position.

11. The device of claim 7 wherein the extension is coupled to the container, the extension configured to contact a portion of the toner distributing member when the toner distributing member reaches the predetermined position.

12. The device of claim 7 wherein the toner distributing member comprises a first end and a second end, the first end pivotally attached to the driving device and the second end having a floating configuration oriented to cause the second end of the toner distributing member to remain towards a surface of the toner.

13. A device to move toner within a container of an image forming apparatus, the device comprising:

a member movably positioned within the container;

a driving device operatively connected to the member to move the member in a reciprocating manner;

the member being shaped to distribute the toner within the container while being maintained towards a surface of the toner when driven in the reciprocating manner; and an extension where movement of the member creates interference between the member and the container when the member reaches a predetermined position.

14. A method of operation in an image forming apparatus that includes a waste toner system, the method comprising:

using a speed-controlled actuator to reciprocatingly drive a toner distributing member that distributes waste toner collected in a waste toner container;

detecting accumulation of waste toner based on monitoring a motor control signal that varies as needed to maintain a desired motor speed while driving the toner distributing member by comparing monitored values of the motor control signal generated over one or more raking cycles to one or more reference values corresponding to nominal accumulation conditions;

creating an interference between the toner distributing member and the waste toner container when the accumulation of waste toner reaches a predetermined value; and detecting a near full condition based on sensing a change in the motor control signal related to the interference between the toner distributing member and the waste toner container.

15. The method of claim 14 wherein creating the interference between the toner distributing member and the waste toner container comprises coupling an extension to at least one of the toner distributing member and the waste toner container.

16. The method of claim 14 wherein the interference occurs at least once per reciprocating cycle of the toner distributing member.

17. The method of claim 14 wherein detecting a near full condition further comprises comparing monitored values of the motor control signal generated during forward and reverse movements of the toner distributing member.

18. The method of claim 14 wherein detecting a near full condition further comprises comparing maximum and minimum monitored values of the motor control signal generated during one or more raking cycles.

19. A method of operation in an image forming apparatus that includes a waste toner system, the method comprising:

driving a toner distributing member that distributes waste toner collected in a waste toner container, the driving occurring in a first direction and in a backwards and forwards manner;

lifting the toner distributing member toward a surface of the waste toner collected in the waste toner container, the lifting occurring in a second direction as the volume of waste toner in the waste toner container changes; and detecting accumulation of waste toner based on monitoring a motor control signal that varies as needed to maintain a desired motor speed while driving the toner distributing member in the first direction by comparing monitored values of the motor control signal generated over one or more raking cycles to one or more reference values corresponding to nominal accumulation conditions.

20. The method of claim 19 further comprising:

coupling an extension to at least one of the toner distributing member and the waste toner container, the extension creating an interference between the toner distributing member and the waste toner container when the accumulation of waste toner reaches a predetermined value; and detecting a near full condition based on sensing a change in the motor control signal related to the interference between the toner distributing member and the waste toner container.

21. The method of claim 20 wherein the interference occurs at least once per backward and forward cycle of the toner distributing member.

22. The method of claim 20 wherein detecting a near full condition further comprises comparing monitored values of the motor control signal generated during forward and backward movements of the toner distributing member.

23. The method of claim 20 wherein detecting a near full condition further comprises comparing maximum and minimum monitored values of the motor control signal generated during one or more backward and forward cycles.

24. The method of claim 19 wherein the first direction is substantially horizontal and the second direction is substantially vertical.

* * * * *